United States Patent [19]

Creed et al.

[11] 4,315,407

[45] Feb. 16, 1982

[54] GAS STORAGE AND TRANSMISSION SYSTEMS

[75] Inventors: Malcolm R. Creed, Brentwood; Ronald B. Gilmour, Woodford Green, both of England

[73] Assignee: British Gas Corporation, London, England

[21] Appl. No.: 158,488

[22] Filed: Jun. 11, 1980

[30] Foreign Application Priority Data

Jun. 26, 1979 [GB] United Kingdom ..... 22252/79

[51] Int. Cl.[3] ..... F17C 7/02

[52] U.S. Cl. ..... 62/53; 62/514 R

[58] Field of Search ..... 62/52, 53, 45, 54, 514 R

[56] References Cited

U.S. PATENT DOCUMENTS 3,535,210 10/1970 Linde et al. ..... 62/52

3,760,597 9/1973 Becker ..... 62/52

*Primary Examiner*—Ronald C. Capossela

*Attorney, Agent, or Firm*—Larson and Taylor

[57] ABSTRACT

Liquefiable gases such as associated natural gas may be liquified, stored in the liquid form and re-vaporized by cooling a pressurized first liquified gas stream by indirect heat exchange with a first stream of a refrigerant, such as liquid nitrogen, to form a second liquified gas stream whose temperature is less than its initial boiling point at ambient pressure and a first warmed refrigerant stream. The second liquified gas stream is passed to a vessel wherein the liquified gas is stored. When the gas is required the second liquified gas is removed from the storage vessel and warmed by indirect heat with a second warmed refrigerant stream, to form a third liquified gas stream and said first refrigerant stream. The warmed refrigerant stream is also in indirect heat exchange with said first warmed refrigerant stream and after heating comprises second warmed refrigerant stream. Thereafter, the third liquified gas stream is vaporized.

4 Claims, 1 Drawing Figure

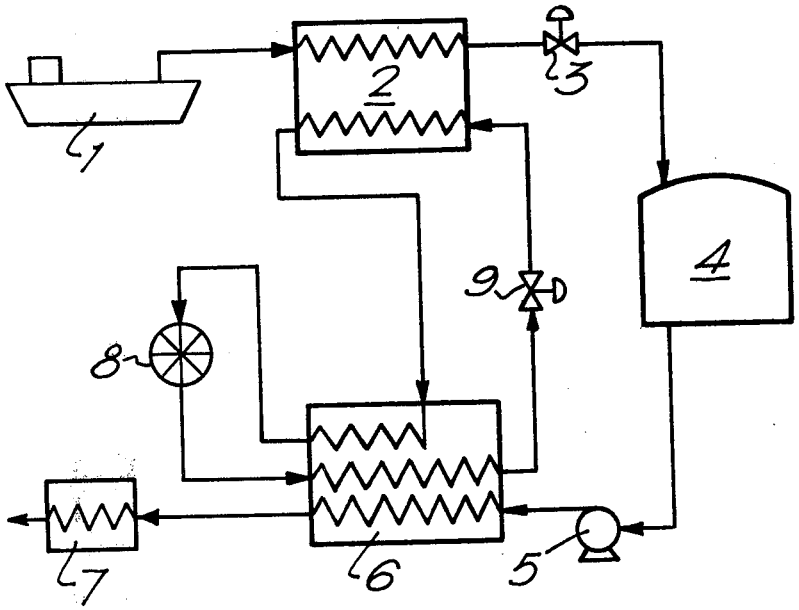
1
2
3
4
5
6
7
8
9

GAS STORAGE AND TRANSMISSION SYSTEMS

This invention relates to a method and apparatus for the storage and transmission of chemical compositions which are normally gaseous, but which may be liquified. More particularly, the invention relates to the transmission and storage of gaseous fuels such as natural gas associated with oil.

Associated gas is normally liquified on the production platform or on board specially constructed barges or ships, transferred to a land-based terminal as liquified natural gas (LNG) stored at the terminal as LNG and, when it is required, vaporised into the gas transmission system.

Hitherto, LNG has been transported at atmospheric pressure and considerable amounts of energy are required to cool the liquid to a sufficiently low temperature to maintain it in the liquid phase at ambient pressure. It is more economical to transport the LNG at higher temperatures and at higher pressures. However, there are problems in the storage of LNG at super atmospheric pressure.

The present invention proposes apparatus whereby a normally gaseous chemical composition such as LNG can be received in liquified form at a pressure above atmospheric pressure, stored in liquified form at atmospheric pressure and transmitted as a gas at a predetermined line pressure.

In accordance with the present Invention, there is provided method for storing and transmitting liquifiable gases, which method comprises cooling a pressurised flat liquified gas stream by indirect heat exchange with a first refrigerant stream, to form a second liquified gas stream whose temperature is less than its initial boiling point at ambient pressure and a first warmed refrigerant stream, passing the second liquified gas stream to a storage vessel, removing second liquified gas from said storage vessel and warming it by indirect heat exchange with a second warmed refrigerant stream, to form a third liquified gas stream and said first refrigerant stream, said warmed refrigerant stream also also being in indirect heat exchange with said first warmed refrigerant stream to form said second warmed refrigerant stream; and vaporising said third liquified gas stream.

The present invention also provides apparatus for storing and transmitting liquifiable gas comprising a first indirect heat exchange means for cooling a pressurised liquified gas with a refrigerant, means for storing said cooled gas, second indirect heat exchange means for warming said stored cooled gas, said second indirect heat exchange means also including separate means for warming said refrigerant received from said first heat exchange means.

The invention will be described with reference to the accompanying drawings wherein the FIGURE is a schematic representation of apparatus in accordance with the invention.

Pressurised LNG at a temperature above its ambient pressure bubble temperature is passed from the carrier 1, through a heat exchanger 2, where it subcools to its ambient pressure bubble temperature, and is reduced in pressure through valve 3 to the LNG storage tank 4.

Meanwhile, LNG from the tank 4 is pumped up to pipeline pressure in pump 5 warmed in exchanger 6 and vaporised in the base load vaporiser 7 into the pipeline.

A refrigerant circuit of nitrogen acts as a heat pump between exchangers 2 and 6. Nitrogen is compressed to a high pressure in compressor 8 and cooled and partially liquified against the base load LNG output and returning low pressure nitrogen in Exchanger 6. The nitrogen is expanded through valve 6 where it further cools. The cold nitrogen warms in exchanger 2 as it subcools the LNG unloaded from the carrier.

We claim:

1. A method for storing and transmitting liquifiable gases, which method comprises cooling a pressurized first liquified gas stream by indirect heat exchange with a first refrigerant stream, to form a second liquified gas stream whose temperature is less than its initial boiling point at ambient pressure and a first warmed refrigerant stream, passing the second liquified gas stream to a storage vessel and storing said second liquified gas stream at ambient pressure, removing second liquified gas from said storage vessel and warming it by indirect heat exchange with a second warmed refrigerant stream, to form a third liquified gas stream and said first refrigerant stream, said warmed refrigerant stream also being in indirect heat exchange with said first warmed refrigerant stream to form second warmed refrigerant stream; and vaporizing said third liquified gas stream.

2. A method as claimed in claim 1 wherein the liquifiable gas is associated natural gas.

3. A method is claimed in claim 1 or claim 2 in which the refrigerant is liquid nitrogen.

4. Apparatus for storing and transmitting liquifiable gas comprising a first indirect heat exchange means for cooling a pressurized liquified gas with a refrigerant, means for storing said cooled gas, means communicating said first indirect heat exchange means and said storage means, second indirect heat exchange means for warming said stored cooled gas, and means communicating said second indirect heat exchange means with said storage means, said second indirect heat exchange means also including separate means for warming said refrigerant received from said first heat exchange means.

* * * * *